US006844125B2

(12) United States Patent
Ito

(10) Patent No.: US 6,844,125 B2
(45) Date of Patent: Jan. 18, 2005

(54) COMBINATION OF DEVELOPING AGENTS, IMAGE FORMING APPARATUS, AND METHOD FOR FORMING IMAGE

(75) Inventor: Tsuyoshi Ito, Mishima (JP)

(73) Assignees: Kabushiki Kaisha Toshiba, Tokyo (JP); Toshiba Tec Kabushiki Kaisha, Tokyo (JP)

( * ) Notice: Subject to any disclaimer, the term of this patent is extended or adjusted under 35 U.S.C. 154(b) by 40 days.

(21) Appl. No.: 10/392,402

(22) Filed: Mar. 20, 2003

(65) Prior Publication Data

US 2004/0185356 A1 Sep. 23, 2004

(51) Int. Cl.[7] ..... G03G 9/10
(52) U.S. Cl. ..... 430/107.1; 430/111.4
(58) Field of Search ..... 430/107.1, 111.4

(56) References Cited

U.S. PATENT DOCUMENTS 5,733,692 A * 3/1998 Nagase et al. ..... 430/45

FOREIGN PATENT DOCUMENTS

| | | |
|---|---|---|
| JP | 5-107864 A | 4/1993 |
| JP | 6-222645 A | 8/1994 |
| JP | 2000-122370 A | 4/2000 |

* cited by examiner

*Primary Examiner*—Mark A. Chapman
(74) *Attorney, Agent, or Firm*—Foley & Lardner LLP

(57) ABSTRACT

Disclosed is a combination of developing agents by which letting Ry micrometer be the volume-average particle diameter of a yellow developing agent, and R micrometer be the volume-average particle diameter of a non-yellow color developing agent, R<Ry and 4<R<11, and letting Ty (° C.) be the softening point of the yellow developing agent, and T (° C.) be the average value of the softening points of non-yellow color developing agents, Ty>T.

12 Claims, 2 Drawing Sheets

COMBINATION OF DEVELOPING AGENTS, IMAGE FORMING APPARATUS, AND METHOD FOR FORMING IMAGE

BACKGROUND OF THE INVENTION

The present invention relates to image forming apparatuses such as an electrostatic recording apparatus and electrophotographic apparatus, a method for forming an image, and developing agents for use in the apparatuses and method.

Presently, a high image quality of a color copying machine and printer is an essential factor. To improve the image quality, toner characteristics required to be improved are particle diameter, charging properties, toner shape, and the like. Of these characteristics, the particle diameter is particularly important. As the particle diameter of toner decreases, the reproducibility of dots and thin lines improves.

A polymerization method and pulverization method are examples of a toner manufacturing method. Of these methods, the pulverization method is generally used because the cost is low. However, when this pulverization method is used, the manufacturing cost increases as the particle diameter of toner decreases. A polyester-based resin often used in color toner has high affinity for paper and hence is advantageous in fixing properties, but has the disadvantages that, because the resin is hard, the pulverization time prolongs and the yield worsens. Therefore, this polyester-based resin is inferior in pulverization efficiency to a styrene-acryl-based resin normally used in monochrome toner.

In addition, the material of monochrome toner is relatively inexpensive since an inexpensive coloring agent called carbon black is used. In contrast, the materials of color toners are expensive because expensive yellow, magenta, and cyan pigments are used. A yellow pigment usable in toner is particularly expensive.

Also, the offset properties and transparency of color toner are very important because colors are overlaid on each other. Accordingly, a binder resin, wax, and the like of color toner are often required to have more functions than required of monochrome toner. Furthermore, to improve the dispersibility of a color pigment with respect to a binder resin in a kneading process, it has been demanded to further improve the dispersion technique.

As described above, the material cost and manufacturing cost of color toner are inevitably higher than those of monochrome toner, and this increases the cost of the final product.

BRIEF SUMMARY OF THE INVENTION

The present invention has been made in consideration of the above situation, and has as its first object to provide a combination of high-quality, low-cost color developing agents.

It is the second object of the present invention to provide an image forming apparatus capable of forming a high-quality, low-cost color image.

It is the third object of the present invention to provide an image forming method capable of forming a high-quality, low-cost color image.

A combination of developing agents according to the present invention comprises a yellow developing agent, and at least one non-yellow color developing agent selected from the group consisting of a magenta developing agent, cyan developing agent, and black developing agent, wherein the yellow and non-yellow color developing agents contain a binder resin and coloring agent, and are obtained by a pulverization method, letting Ry micrometer be the volume-average particle diameter of the yellow developing agent, and R micrometer be the volume-average particle diameter of the non-yellow color developing agent, $R<Ry$ and $4<R<11$, and letting Ty (° C.) be the softening point of the yellow developing agent, and T (° C.) be the average value of the softening points of the non-yellow color developing agents, $Ty>T$.

An image forming apparatus of the present invention comprises an image carrier, a first developing device which contains a first developing agent, and forms a first developing agent image by developing an electrostatic latent image formed on the image carrier by using the first developing agent, a second developing device which contains a second developing agent, and forms a second developing agent image by developing an electrostatic latent image formed on the image carrier by using the second developing agent, a transfer device to transfer the first and second developing agent images, and a fixing device including a heating member and pressing member to fix the transferred first and second developing agent images, wherein the first developing agent is a yellow developing agent, and the second developing agent is a non-yellow color developing agent selected from the group consisting of a magenta developing agent, cyan developing agent, and black developing agent, the yellow and non-yellow color developing agents contain a binder resin and coloring agent, and are obtained by a pulverization method, letting Ry micrometer be the volume-average particle diameter of the yellow developing agent, and R micrometer be the volume-average particle diameter of the non-yellow color developing agent, $R<Ry$ and $4<R<11$, and letting Ty (° C.) be the softening point of the yellow developing agent, and T (° C.) be the average value of the softening points of the non-yellow color developing agents, $Ty>T$.

A method for forming an image of the present invention comprises a development/transfer step of developing and transferring first and second electrostatic latent images individually formed on an image carrier by using first and second developing agents different in color, thereby forming first and second developing agent images on a transfer medium, and a fixing step of fixing, on the transfer medium, the first and second developing agent images transferred onto the transfer medium, by using a heating member and pressing member, wherein the first developing agent is a yellow developing agent, and the second developing agent is a non-yellow color developing agent selected from the group consisting of a magenta developing agent, cyan developing agent, and black developing agent, the yellow and non-yellow color developing agents contain a binder resin and coloring agent, and are obtained by a pulverization method, letting Ry micrometer be the volume-average particle diameter of the yellow developing agent, and R micrometer be the volume-average particle diameter of the non-yellow color developing agent, $R<Ry$ and $4<R<11$, and letting Ty (° C.) be the softening point of the yellow developing agent, and T (° C.) be the average value of the softening points of the non-yellow color developing agents, Ty>T.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Figure 1:
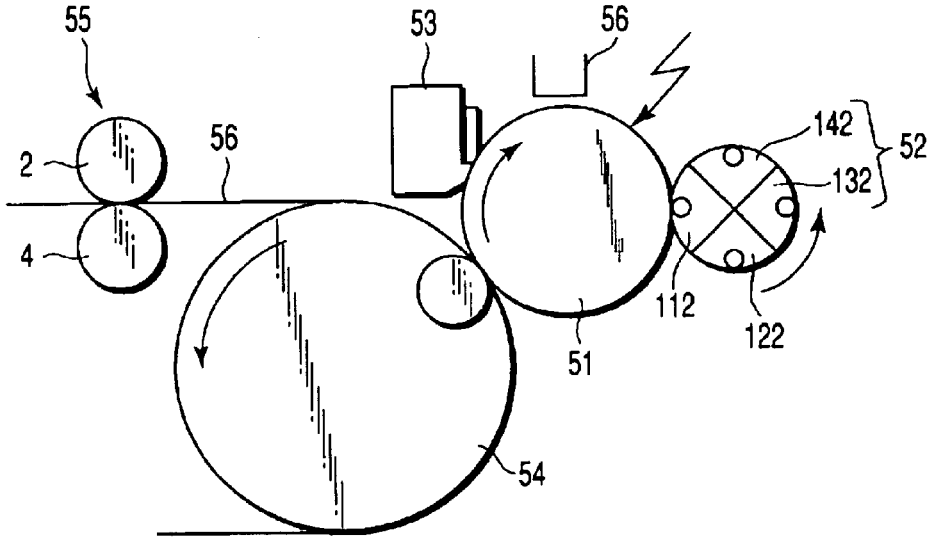
FIG. 1 is a view showing an example of an image forming apparatus of the present invention.

A developing agent according to the first aspect of the present invention is a developing agent obtained by a pulverization method and is a combination of a yellow developing agent and non-yellow color developing agent, wherein letting Ry micrometer be the volume-average particle diameter of the yellow developing agent, and R micrometer be the volume-average particle diameter of the non-yellow color developing agent, R<Ry and 4<R<11, and letting Ty (° C.) be the softening point of the yellow developing agent, and T (° C.) be the average value of the softening points of the non-yellow color developing agents, Ty>T.

The non-yellow color developing agent is one developing agent or a combination of two or more developing agents selected from a magenta developing agent, cyan developing agent, and black developing agent.

In the present invention, a combination of a magenta developing agent, cyan developing agent, and black developing agent is preferably used as the non-yellow color developing agent. A full-color image having high reproducibility can be formed by the use of a combination of four color developing agents, i.e., a yellow developing agent, magenta developing agent, cyan developing agent, and black developing agent.

Each of the yellow and non-yellow color developing agents contains a binder resin and coloring agent.

The yellow developing agent contains a binder resin and yellow coloring agent, the magenta developing agent contains a binder resin and magenta coloring agent, the cyan developing agent contains a binder resin and cyan coloring agent, and the black developing agent contains a binder resin and black coloring agent.

An image forming apparatus according to the second aspect of the present invention uses the combination of developing agents according to the first aspect described above, and comprises an image carrier, a first developing device which contains a first developing agent, and forms a first developing agent image by developing an electrostatic latent image formed on the image carrier by using the first developing agent, a second developing device which contains a second developing agent, and forms a second developing agent image by developing an electrostatic latent image formed on the image carrier by using the second developing agent, a transfer device to transfer the first and second developing agent images, and a fixing device including a fixing member to fix the transferred first and second developing agent images.

In the image forming apparatus of the present invention, the yellow developing agent of the combination of developing agents described above is applied as the first developing agent, and the non-yellow color developing agent described above is applied as the second developing agent.

The second developing device can have one developing portion when one color developing agent selected from the magenta developing agent, cyan developing agent, and black developing agent is used as the non-yellow color developing agent. When two or more color developing agents are used in combination as the non-yellow color developing agent, the developing device can include two or more developing portions in accordance with the number of the color developing agents used except for yellow. Each developing portion can contain one color developing agent.

A method for forming an image according to the third aspect of the present invention is an image forming method using the combination of developing agents described above, and comprises a development/transfer step of developing and transferring first and second electrostatic latent images individually formed on an image carrier by using first and second developing agents different in color, thereby forming first and second developing agent images on a transfer medium, respectively, and a fixing step of fixing, on the transfer medium, the first and second developing agent images transferred onto the transfer medium, by having a heating member and pressing member, wherein the yellow developing agent of the combination of developing agents described above is applied as the first developing agent, and the non-yellow color developing agent described above is applied as the second developing agent.

The present invention uses developing agents obtained by a pulverization method.

The pulverization method is one developing agent manufacturing method including a step of melting and kneading developing agent materials such as a coloring agent and binder resin, a step of cooling and pulverizing the kneaded product, and a step of classifying the pulverized product to obtain a developing agent having a desired particle diameter.

As the particle diameter of toner using this pulverization method is decreased, the pulverization efficiency of the toner decreases, and the manufacturing cost of the toner increases.

Also, it is very difficult for the human eye to perceive a monochromatic image of a yellow developing agent, unlike non-yellow developing agents such as magenta, cyan, and black developing agents.

In the present invention, therefore, the manufacturing cost of the yellow developing agent is reduced by making the volume-average particle diameter of the yellow developing agent larger than that of the non-yellow color developing agent, thereby shortening the pulverization time and raising the pulverization efficiency. However, if the volume-average particle diameter of the yellow developing agent increases, the graininess may become conspicuous by spread of dots. In contrast, in the present invention, the softening point of the yellow developing agent is made higher than that of the non-yellow color developing agent, thereby making the melt viscosity of the yellow developing agent higher than that of the non-yellow color developing agent. Since this reduces dot spread of the yellow developing agent having a larger particle diameter, high-quality images having no conspicuous graininess can be formed.

As described above, the present invention can form inexpensive high-quality images.

The volume-average particle diameters Ry and R preferably satisfy the relationship represented by $R<Ry\leqq R+3$. When these values fall within this range, particularly a graininess difference caused by the difference between the particle diameters of the yellow developing agent and non-yellow developing agent is inconspicuous.

More preferably, the volume-average particle diameters Ry and R satisfy the relationship represented by $R+1<Ry\leqq R+3$. When these values fall within this range, particularly the graininess difference is inconspicuous, and the effect of reducing the manufacturing cost increases.

The volume-average particle diameter of the yellow developing agent used in the present invention is preferably 6 to 13 $\mu$m, and more preferably, 7 to 12 $\mu$m. If this volume-average particle diameter is less than 6 $\mu$m, the manufacturing cost tends to increase. If the volume-average particle diameter exceeds 13 $\mu$m, the image graininess tends to worsen.

The volume-average particle diameter of the non-yellow color developing agent used in the present invention is preferably 5 to 10 $\mu$m, and more preferably, 6 to 9 $\mu$m. If this volume-average particle diameter is less than 5 $\mu$m, the manufacturing cost tends to increase. If the volume-average particle diameter exceeds 10 $\mu$m, the image graininess tends to worsen.

The softening point of the yellow developing agent is preferably 90° C. to 140° C., and more preferably, 95° C. to 130° C. If this softening point is less than 90° C., the lower-limit temperature of a non-offset region tends to rise. If the softening point exceeds 140° C., the upper-limit temperature of the non-offset region tends to lower.

The softening point of the non-yellow developing agent is preferably 90° C. to 130° C., and more preferably, 95° C. to 120° C. If this softening point is less than 90° C., the lower-limit temperature of the non-offset region tends to rise. If the softening point exceeds 130° C., the upper-limit temperature of the non-offset region tends to lower.

The melt viscosity at 110° C. of the yellow developing agent is favorably $3.0\times10^3$ to $2.5\times10^5$ Pa·S.

The melt viscosity at 110° C. of the non-yellow developing agent is favorably $3.0\times10^3$ to $2.0\times10^5$ Pa·S.

Examples of the binder resin are a polyester resin, a polystyrene resin, a styrene-acrylate copolymer, an epoxy resin, and mixtures of several types of these materials.

Binder resins used in the yellow developing agent, magenta developing agent, cyan developing agent, and black developing agent can be the same or different, as long as the resins have satisfactory transparency and fixing properties when used in the color developing agents. Preferably, resins having the same repeating unit can be used.

Most preferably, a polyester resin having high affinity for paper can be used.

As a coloring agent, it is possible to use, e.g., carbon black and organic or inorganic pigments or dyes.

As carbon black, it is possible to use, e.g., acetylene black, furnace black, thermal black, channel black, or ketjen black.

As a pigment or dye, it is possible to use, e.g., Fast Yellow G, Benzidine Yellow, PV Fast Yellow HG, Indo Fast Orange, Irgazine Red, Carmine FB, Carmine 6B, Permanent Bordeaux FRR, Pigment Orange R, Lithol Red 2G, Lake Red C, Quinacridone Red, Rhodamine FB, Rhodamine B Lake, Phthalocyanine Blue, Pigment Blue, Indanthrone Blue, Brilliant Green B, and Phthalocyanine Green.

Examples of a release agent are natural wax such as rice wax and carnauba wax, petroleum wax such as paraffin wax, and synthetic wax such as fatty ester, fatty amide, low-molecular-weight polyethylene, and low-molecular-weight polypropyrene.

Also, a charge control agent, lubricant, fluidizing agent, and the like can be added as needed.

In the image forming apparatus according to the present invention, one surface of at least one of the heating member and pressing member has an ASKER-C hardness of preferably 30° to 70°, and more preferably, 40° to 65°. When this relatively soft fixing member is used, high-quality images can be obtained because dot spread of transferred developing agents is reduced. However, if the ASKER-C hardness is less than 30°, the pressing force of the fixing member reduces, and the fixing properties worsen. If the ASKER-C hardness exceeds 70°, dot spread of the yellow developing agent tends to increase.

FIG. 1 shows an example of the image forming apparatus of the present invention. As shown in FIG. 1, a developing unit 52 having a structure in which four developing devices 112, 122, 132, and 142 each containing one developing agent of the combination of developing agents having four colors, i.e., yellow, cyan, magenta, and black according to the present invention are rotatably integrated is placed on a common photoreceptor drum 51. On the downstream side of the developing unit 52, a transfer roller 54 capable of rotating in synchronism with the photoreceptor drum 51, a cleaning device 53, and a charge removing device 56 are arranged. In addition, a fixing device 55 including a heating roller 2 and press roller 4 is placed downstream of the photoreceptor drum 51. In this apparatus, the developing device 112 develops an electrostatic latent image formed on the common photoreceptor drum 51. The obtained developing agent image is transferred onto a sheet 56 conveyed to a transfer position between the transfer roller 54 and the photoreceptor drum 51. After that, the photoreceptor drum 51 is cleaned by the cleaning device 53, and the electric charge on the photoreceptor drum 51 is removed by the charge removing device 56, thereby completing one cycle of transfer. Next, the developing device 122 performs development, and a similar transfer operation is performed. Furthermore, the developing devices 132 and 142 perform development and transfer in the same manner as above. The developing agent images thus transferred onto the sheet 56 are fixed by the fixing device 55.

Figure 2:
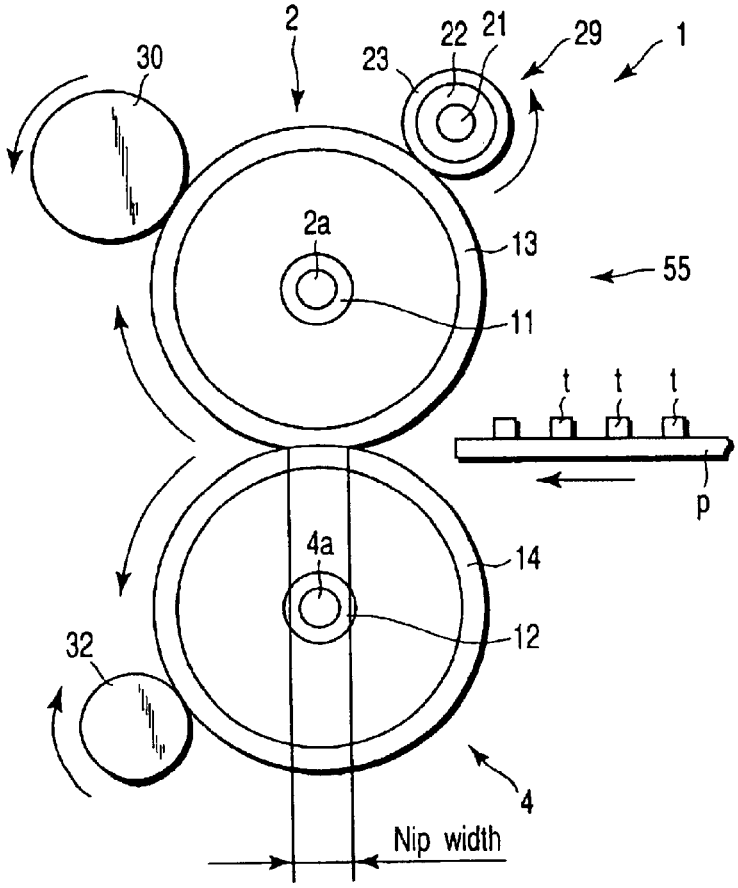
FIG. 2 is a view showing an example of a fixing device used in the present invention.

FIG. 2 is a view showing an example of the arrangement of the fixing device 55.

As shown in FIG. 2, the fixing device 55 has the heating roller 2 which contains a heater 2*a* and has a surface having an ASKER-C hardness of 63°, a cleaning roller 30 capable of rotating in synchronism with the heating roller 2, an oil coating mechanism capable of rotating in synchronism with the heating roller 2 and having a core metal 21, holding layer 22, and surface layer 23, the press roller 4 which contains a heater 4*a*, can press the heating roller 2 with a nip width of 9 mm, and has a surface having an ASKER-C hardness of 81°, and a cleaning roller 32 capable of rotating in synchronism with the press roller 4.

Reference Examples

Manufacture of Yellow Developing Agents

Manufacture of Master Batch

A yellow master batch was formed by melting and kneading the following master batch materials by using a press kneader manufactured by MORIYAMA COMPANY LTD. and a triple roll mill manufactured by ASHIZAWA Co, LTD.

| Yellow master batch materials | |
|---|---|
| Polyester resin (softening point 100° C.) | 60 parts by weight |
| Pigment Yellow 180 (manufactured by Clariant K.K.) | 40 parts by weight |

86 parts by weight of the same polyester resin, 3 parts by weight of rice wax, and 1 part by weight of the E-84 salicylic acid derivative complex manufactured by Orient Chemical Industries, LTD were added to 10 parts by weight of the obtained yellow master batch. These materials were uniformly mixed by a Henschel mixer manufactured by MITSUI MINING Co, LTD., and melted and kneaded by a biaxial extruder manufactured by KOBE STEEL, Ltd.

The obtained kneaded product was coarsely pulverized by a hammer mill and then finely pulverized by using a fine pulverizer manufactured by NIPPON PNEUMATIC MFG, Co, LTD, while the conditions such as the air pressure and feed amount were variously changed. After that, the pulverized product was classified by a classification machine to obtain toner particles having volume-average particle diameters D50 of 4, 5, 6, 7, 8, 9, 10, 11, 12, and 15 $\mu$m.

1 part by weight of hydrophobic silica having a volume-average particle diameter D50 of 100 nm and 1 part by weight of titanium oxide having a volume-average particle diameter D50 of 20 nm were mixed in and adhered to 100 parts by weight of the obtained toner particles in the Henschel mixer, thereby obtaining yellow developing agents.

Manufacture of Magenta Developing Agents

A magenta master batch was formed following the same procedure as for the yellow master batch described above except that the following magenta master batch materials were used.

| Magenta master batch materials | |
|---|---|
| Polyester resin (described above) | 60 parts by weight |
| Pigment Red 122 (manufactured by Clariant K.K.) | 40 parts by weight |

81 parts by weight of the same polyester resin, 3 parts by weight of rice wax, and 1 part by weight of the E-84 salicylic acid derivative complex manufactured by Orient Chemical Industries, LTD were added to 15 parts by weight of the obtained magenta master batch. These materials were uniformly mixed by the Henschel mixer manufactured by MITSUI MINING CO, LTD., and melted and kneaded by the biaxial extruder manufactured by KOBE STEEL, Ltd.

The obtained kneaded product was coarsely pulverized by a hammer mill and then finely pulverized by using the fine pulverizer manufactured by NIPPON PNEUMATIC MFG, Co, LTD, while the conditions such as the air pressure and feed amount were variously changed. After that, the pulverized product was classified by a classification machine to obtain toner particles having volume-average particle diameters D50 of 4, 5, 6, 7, 8, 9, 10, 11, 12, and 15 $\mu$m.

1 part by weight of hydrophobic silica having a volume-average particle diameter D50 of 100 nm and 1 part by weight of titanium oxide having a volume-average particle diameter D50 of 20 nm were mixed in and adhered to 100 parts by weight of the obtained toner particles in the Henschel mixer, thereby obtaining a plurality of types of yellow developing agents having different volume-average particle diameters D50.

Manufacture of Cyan Developing Agents

A cyan master batch was formed following the same procedure as for the yellow master batch described above except that the following cyan master batch materials were used.

| Cyan master batch materials | |
|---|---|
| Polyester resin (described above) | 60 parts by weight |
| Pigment Blue 15:3 (manufactured by Clariant K.K.) | 40 parts by weight |

86 parts by weight of the same polyester resin, 3 parts by weight of rice wax, and 1 part by weight of the E-84 salicylic acid derivative complex manufactured by Orient Chemical Industries, LTD were added to 10 parts by weight of the obtained cyan master batch. These materials were uniformly mixed by the Henschel mixer manufactured by MITSUI MINING, Co, LTD., and melted and kneaded by the biaxial extruder manufactured by KOBE STEEL, Ltd.

The obtained kneaded product was classified in the same manner as for the magenta developing agents to obtain toner particles having volume-average particle diameters D50 of 4, 5, 6, 7, 8, 9, 10, 11, 12, and 15 $\mu$m.

1 part by weight of hydrophobic silica having a volume-average particle diameter D50 of 100 nm and 1 part by weight of titanium oxide having a volume-average particle diameter D50 of 20 nm were mixed in and adhered to 100 parts by weight of the obtained toner particles in the Henschel mixer, thereby obtaining a plurality of types of cyan developing agents having different volume-average particle diameters D50.

| Manufacture of black developing agents | |
|---|---|
| Polyester resin (described above) | 60 parts by weight |
| Carbon Black (manufactured by CABOT Co, LTD.) | 40 parts by weight |

86 parts by weight of the same polyester resin, 3 parts by weight of rice wax, and 1 part by weight of the E-84 salicylic acid derivative complex manufactured by Orient Chemical Industries, LTD were added to 10 parts by weight of the obtained black master batch. These materials were uniformly mixed by the Henschel mixer manufactured by MITSUI MINING CO, LTD., and melted and kneaded by the biaxial extruder manufactured by KOBE STEEL, Ltd.

The obtained kneaded product was finely pulverized in the same manner as for the magenta developing agents, and classified to obtain toner particles having volume-average particle diameters D50 of 4, 5, 6, 7, 8, 9, 10, 11, 12, and 15 μm.

1 part by weight of hydrophobic silica having a volume-average particle diameter D50 of 100 nm and 1 part by weight of titanium oxide having a volume-average particle diameter D50 of 20 nm were mixed in and adhered to 100 parts by weight of the obtained toner particles in the Henschel mixer, thereby obtaining a plurality of types of black developing agents having different volume-average particle diameters D50.

The volume-average particle diameter D50 of toner was measured by Coulter Multisizer II available from COULTER Co, LTD. The aperture diameter of Coulter Multisizer II was 100 μm, and the measurement was done by using a solution in which toner was dispersed in an electrolytic solution by a surfactant.

The softening point of toner was measured by Flow Tester CFT-500 available from SHIMADZU Corporation. The measurement conditions are shown in Table 1 below.

TABLE 1

| Flow tester measurement Conditions | |
|---|---|
| Item | Set condition |
| RATE TEMP | 2.5° C./min |
| SET TEMP | 40° C. |
| MAX TEMP | 200° C. |
| INTERVAL | 2.5° C. |
| PREHEAT | 300 sec |
| POS.MIN | 0 mm |
| POS.MAX | 15 mm |
| LOAD | 10 kg |
| DIE (DIA) | 1 mm |
| DIE (LENG) | 1 mm |
| PLUNGER | 1 $cm^2$ |

The softening point measurement was performed by a heat-up method, and that point on a curve, which corresponded to a plunger fall amount of 2 mm was taken as the softening point. The softening point of each of the obtained developing agents was 93° C.

Reference Example 1

Evaluation of Particle Diameter and Image Quality of Each Color Developing Agent A full-color coping machine including the fixing device shown in FIG. 2 and modified for tests was prepared such that the toner adhesion amount was fixed and the fixing conditions were changeable. By using the fixing device 55, a monochromatic grayscale chart was output for each of the developing agents having the various particle diameters described above while the fixing conditions were set such that the fixing temperature was 150° C. and the roller speed of the heating roller 2 and press roller 4 was 230 cpm.

By using this grayscale chart, the particle diameter and graininess level of each color developing agent were visually evaluated. The results are shown in Table 2 below and FIG. 3.

TABLE 2

| | Graininess level with respect to particle diameter | | | |
|---|---|---|---|---|
| | Graininess level | | | |
| D50 μm | Y | M | C | K |
| 15 | 2 | 2 | 2 | 2 |
| 12 | 5 | 4 | 4 | 4 |
| 11 | 6 | 5 | 5 | 5 |
| 10 | 7 | 5 | 5 | 5 |
| 9 | 7 | 6 | 6 | 6 |
| 8 | 8 | 6 | 6 | 6 |
| 7 | 8 | 7 | 7 | 7 |
| 6 | 9 | 8 | 8 | 8 |
| 5 | 9 | 9 | 9 | 9 |
| 4 | 9 | 9 | 9 | 9 |

Figure 3:
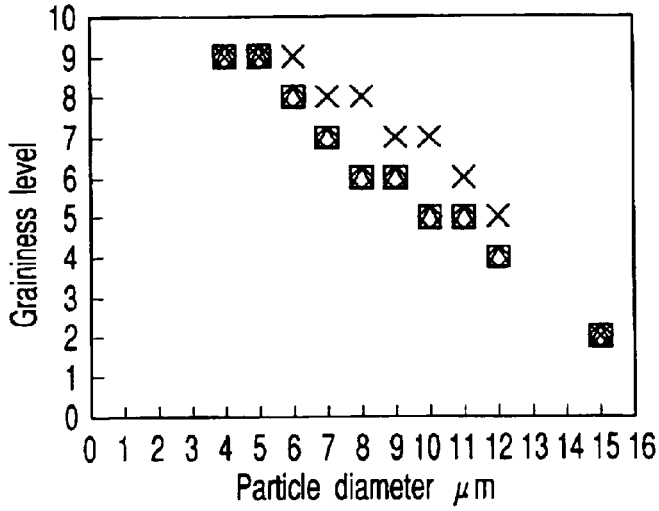
FIG. 3 is a graph showing the relationship between the particle diameter of a developing agent and the graininess.

In FIG. 3, X indicates a yellow developing agent; □, a magenta developing agent; Δ, a cyan developing agent; and ◇, a black developing agent.

The higher the numerical value of the graininess level, the lower the graininess. The graininess particularly has influence on a low-density portion of the grayscale pattern. There was no graininess difference between the magenta developing agent, cyan developing agent, and black developing agent having the same particle diameter. However, the graininess of the yellow developing agent was better than that of the magenta, cyan, and black developing agents for the same particle diameter.

On the basis of the results shown in Table 2, maximum particle diameters required to allow the yellow developing agent and the magenta, cyan, and black developing agents to have the same graininess level and differences between these maximum particle diameters were obtained. The results are shown in Table 3 below.

TABLE 3

| Maximum particle diameter necessary to obtain the same level of image quality | | | |
|---|---|---|---|
| Graininess level | Y | M, C, K | Particle diameter difference |
| 9 | 6 | 5 | 1 |
| 8 | 8 | 6 | 2 |
| 7 | 10 | 7 | 3 |
| 6 | 11 | 9 | 2 |
| 5 | 12 | 11 | 1 |
| 4 | 12 | 12 | 0 |
| 2 | 15 | 15 | 0 |

Table 3 shows that when the particle diameters of magenta, cyan, and black are set at, e.g., 4 to 11 μm, image quality can be maintained even if the particle diameter of only yellow is increased by 1 to 3 μm.

In addition, full-color images of a person and landscape were output by using a yellow developing agent having a particle diameter of 8 μm and magenta, cyan, and black developing agents having a particle diameter of 6 μm. Consequently, the images had high image quality without any graininess.

Reference Example 2

Surface Hardness of Heating and Pressing Members

Monochromatic grayscale charts were output for yellow developing agents and magenta developing agents obtained following the same procedures as in the above-mentioned reference example except that the ASKER-C hardness of the heating roller surface was 81°, and graininess evaluation was performed. The results are shown in Tables 4 and 5 below and FIG. 4.

TABLE 4

| Graininess level with respect to particle diameter | Graininess level | |
|---|---|---|
| D50 μm | Y | M |
| 15 | 1 | 1 |
| 12 | 2 | 2 |
| 10 | 4 | 3 |
| 9 | 5 | 4 |
| 8 | 6 | 5 |
| 7 | 6 | 6 |
| 6 | 7 | 7 |
| 5 | 7 | 7 |
| 4 | 8 | 8 |

TABLE 5

| Maximum particle diameter necessary to obtain the same level of image quality | | | |
|---|---|---|---|
| Graininess level | Y | M | Particle diameter difference |
| 8 | 4 | 4 | 0 |
| 7 | 6 | 6 | 0 |
| 6 | 8 | 7 | 1 |
| 5 | 9 | 8 | 1 |
| 4 | 10 | 9 | 1 |
| 3 | 10 | 10 | 0 |
| 2 | 12 | 12 | 0 |
| 1 | 15 | 15 | 0 |

Figure 4:
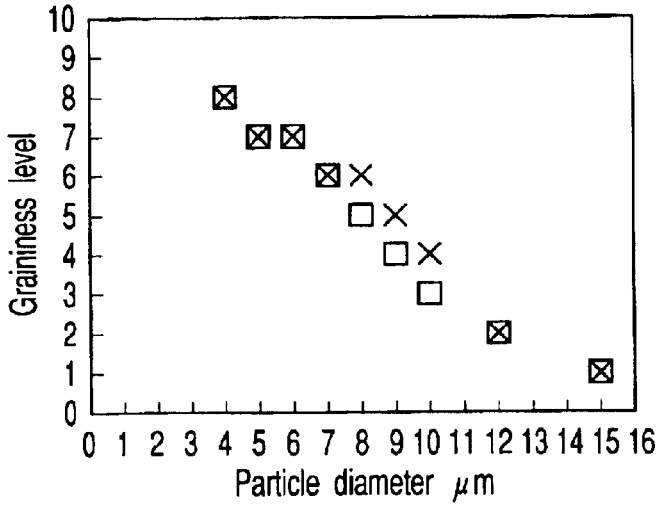
FIG. 4 is a graph showing the relationship between the particle diameter of a developing agent and the graininess when the hardness of the surface of a heating roller is changed.

In FIG. 4, X indicates a yellow developing agent; and □, a magenta developing agent.

There was no graininess level difference compared to the results when the hardness was 63°. This is probably because a high fixing roller hardness applied an excess pressure to toner, so dot spread of the yellow developing agents became conspicuous.

Reference Example 3

Yellow developing agents having particle diameters of 4, 5, 6, 7, 8, 9, 10, 11, 12, and 15 μm were obtained following the same procedures as in Reference Example 1 except that a polyester resin having a softening point of 130° C. was used as the binder resin. The softening point of the obtained yellow developing agents was 120° C.

By using the obtained yellow developing agents, monochromatic grayscale charts were output in the same manner as in Reference Example 1.

Figure 5:
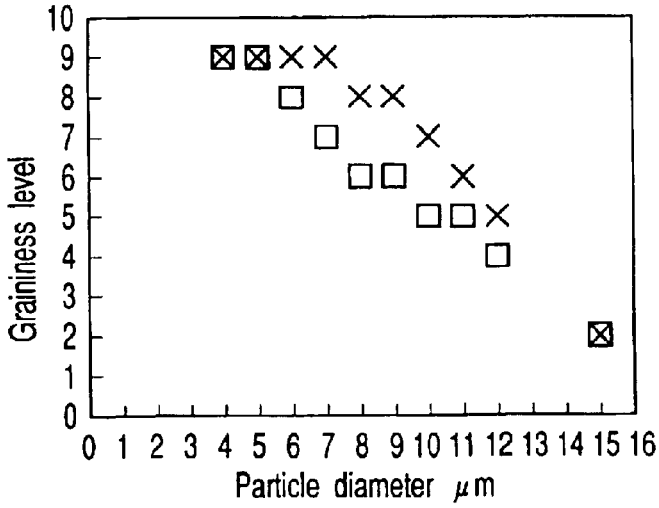
FIG. 5 is a graph showing the relationship between the particle diameter of a developing agent and the graininess when the softening point of a binder resin is changed.

Graininess evaluation was performed in the same manner as in Reference Example 1. The relationship between the particle diameter and graininess of the yellow developing agents and magenta developing agents are shown in FIG. 5 and Tables 6 and 7 below together with the results of the magenta developing agents of Reference Example 1.

TABLE 6

| Graininess level with respect to particle diameter | Graininess level | |
|---|---|---|
| D50 μm | Y | M |
| 15 | 2 | 2 |
| 12 | 5 | 4 |
| 11 | 6 | 5 |
| 10 | 7 | 5 |
| 9 | 8 | 6 |
| 8 | 8 | 6 |
| 7 | 9 | 7 |
| 6 | 9 | 8 |
| 5 | 9 | 9 |
| 4 | 9 | 9 |

TABLE 7

| Maximum particle diameter necessary to obtain the same level of image quality | | | |
|---|---|---|---|
| Graininess level | Y | M | Particle diameter difference |
| 9 | 7 | 5 | 2 |
| 8 | 9 | 6 | 3 |
| 7 | 10 | 7 | 3 |
| 6 | 11 | 9 | 2 |
| 5 | 12 | 11 | 1 |
| 4 | 12 | 12 | 0 |
| 2 | 15 | 15 | 0 |

In FIG. 5, X indicates a yellow developing agent; and □, a magenta developing agent.

When the softening point of the yellow developing agent was made higher than that of the magenta developing agent, the graininess level improved. This is presumably because dot spread of the yellow developing agent became more inconspicuous when the melt viscosity of only the yellow developing agent increased.

EXAMPLES

Examples 1–3, Comparative Examples 1 & 2

Full-color images of a person and landscape were formed by using those yellow developing agents having average particle diameters and softening points shown in Table 8 below and those magenta, cyan, and black developing agents having average particle diameters and softening point average values shown in Table 8, which were obtained following the same procedures as in the reference examples described above.

The graininess was evaluated by visually observing a highlight portion of the image.

The obtained results are shown in Table 8 below.

TABLE 8

| | Y | | M, C, K | | |
|---|---|---|---|---|---|
| | Average particle diameter | Softening point | Average particle diameter | Softening point | Graininess level |
| Example 1 | 7 | 120 | 5 | 93 | 9 |
| Comparative Example 1 | 7 | 93 | 5 | 93 | 8 |
| Example 2 | 9 | 120 | 6 | 93 | 8 |
| Comparative Example 2 | 9 | 93 | 6 | 93 | 7 |
| Example 3 | 11 | 120 | 6 | 93 | 6 |

As shown in Table 8, the graininess levels of Examples 1 and 2 were equal to or better than that of Comparative Example 1.

The graininess level of Comparative Example 2 was worse than those of Examples 1 and 2.

The graininess level of Example 3 was low because the average particle diameter difference was larger than 3 $\mu$m.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A combination of developing agents, comprising:

a yellow developing agent; and at least one non-yellow color developing agent selected from the group consisting of a magenta developing agent, cyan developing agent, and black developing agent, wherein the yellow and non-yellow color developing agents contain a binder resin and coloring agent, and are obtained by a pulverization method, letting Ry micrometer be a volume-average particle diameter of the yellow developing agent, and R micrometer be a volume-average particle diameter of the non-yellow color developing agent, $R<Ry$ and $4<R<11$, and letting Ty (° C.) be a softening point of the yellow developing agent, and T (° C.) be an average value of softening points of the non-yellow color developing agents, $Ty>T$.

2. A combination according to claim 1, wherein the volume-average particle diameters Ry and R satisfy an expression represented by $R<Ry\leqq R+3$.

3. A combination according to claim 2, wherein the volume-average particle diameters Ry and R satisfy an expression represented by $R+1<Ry\leqq R+3$.

4. A combination according to claim 1, wherein the binder resin is a polyester resin.

5. An image forming apparatus comprising an image carrier, a first developing device which contains a first developing agent, and forms a first developing agent image by developing an electrostatic latent image formed on the image carrier by using the first developing agent, a second developing device which contains a second developing agent, and forms a second developing agent image by developing an electrostatic latent image formed on the image carrier by using the second developing agent, a transfer device to transfer the first and second developing agent images, and a fixing device including a heating member and pressing member to fix the transferred first and second developing agent images, wherein the first developing agent is a yellow developing agent, and the second developing agent is a non-yellow color developing agent selected from the group consisting of a magenta developing agent, cyan developing agent, and black developing agent, the yellow and non-yellow color developing agents contain a binder resin and coloring agent, and are obtained by a pulverization method, letting Ry micrometer be a volume-average particle diameter of the yellow developing agent, and R micrometer be a volume-average particle diameter of the non-yellow color developing agent, $R<Ry$ and $4<R<11$, and letting Ty (° C.) be a softening point of the yellow developing agent, and T (° C.) be an average value of softening points of the non-yellow color developing agents, $Ty>T$.

6. An image forming apparatus according to claim 5, wherein the volume-average particle diameters Ry and R satisfy an expression represented by $R<Ry\leqq R+3$.

7. An image forming apparatus according to claim 6, wherein the volume-average particle diameters Ry and R satisfy an expression represented by $R+1<Ry\leqq R+3$.

8. An image forming apparatus according to claim 5, wherein at least one of the heating member and pressing member has an ASKER-C hardness of 30 to 70°.

9. A method for forming an image, comprising:

a development/transfer step of developing and transferring first and second electrostatic latent images individually formed on an image carrier by using first and second developing agents different in color, thereby forming first and second developing agent images on a transfer medium; and a fixing step of fixing, on the transfer medium, the first and second developing agent images transferred onto the transfer medium, by using a heating member and pressing member, wherein the first developing agent is a yellow developing agent, and the second developing agent is a non-yellow color developing agent selected from the group consisting of a magenta developing agent, cyan developing agent, and black developing agent, the yellow and non-yellow color developing agents contain a binder resin and coloring agent, and are obtained by a pulverization method, letting Ry micrometer be a volume-average particle diameter of the yellow developing agent, and R micrometer be a volume-average particle diameter of the non-yellow color developing agent, $R<Ry$ and $4<R<11$, and letting Ty (° C.) be a softening point of the yellow developing agent, and T (° C.) be an average value of softening points of the non-yellow color developing agents, $Ty>T$.

10. A method for forming an image according to claim 9, wherein the volume-average particle diameters Ry and R satisfy an expression represented by $R<Ry\leqq R+3$.

11. A method for forming an image according to claim 10, wherein the volume-average particle diameters Ry and R satisfy an expression represented by $R+1<Ry\leqq R+3$.

12. A method for forming an image according to claim 9, wherein at least one of the heating member and pressing member has an ASKER-C hardness of 30 to 70°.

* * * * *